US011162727B2

(12) United States Patent
Larsen et al.

(10) Patent No.: US 11,162,727 B2
(45) Date of Patent: Nov. 2, 2021

(54) METHOD FOR CONTROLLING SUCTION PRESSURE BASED ON A MOST LOADED COOLING ENTITY

(71) Applicant: Danfoss A/S, Nordborg (DK)

(72) Inventors: Lars Finn Sloth Larsen, Nordborg (DK); Jan Prins, Nordborg (DK); Torben Green, Nordborg (DK)

(73) Assignee: Danfoss A/S, Nordborg (DK)

( * ) Notice: Subject to any disclaimer, the term of this patent is extended or adjusted under 35 U.S.C. 154(b) by 61 days.

(21) Appl. No.: 16/608,311

(22) PCT Filed: Apr. 25, 2018

(86) PCT No.: PCT/EP2018/060572
§ 371 (c)(1),
(2) Date: Oct. 25, 2019

(87) PCT Pub. No.: WO2018/202496
PCT Pub. Date: Nov. 8, 2018

(65) Prior Publication Data

US 2020/0191460 A1 Jun. 18, 2020

(30) Foreign Application Priority Data

May 1, 2017 (DK) ..... PA201700276

(51) Int. Cl.
*F25B 49/02* (2006.01)
*F25B 5/02* (2006.01)

(52) U.S. Cl.
CPC ..... *F25B 49/022* (2013.01); *F25B 5/02* (2013.01); *F25B 2400/075* (2013.01);
(Continued)

(58) Field of Classification Search
CPC .... F25B 49/02; F25B 49/022; F25B 2600/02; F25B 2600/025; F25B 2600/0272
See application file for complete search history.

(56) References Cited

U.S. PATENT DOCUMENTS 4,084,388 A * 4/1978 Nelson ..... G05D 23/24 62/152
4,951,475 A 8/1990 Alsenz
(Continued)

FOREIGN PATENT DOCUMENTS

CN 101539355 A 9/2009
CN 202792671 U 3/2013
(Continued)

OTHER PUBLICATIONS

International Search Report for PCT Serial No. PCT/EP2018/060572 dated Jun. 28, 2018.

*Primary Examiner* — Jonathan Bradford
(74) *Attorney, Agent, or Firm* — McCormick, Paulding & Huber PLLC

(57) ABSTRACT

A method for controlling suction pressure in a vapour compression system including one or more cooling entities is disclosed. For each cooling entity, a maximum required suction pressure and/or a required change in suction pressure for maintaining a target temperature in the refrigerated volume is obtained. A most loaded cooling entity among the one or more cooling entities is identified, based on the maximum required suction pressures and/or the required changes in suction pressure. The suction pressure of the vapour compression system is controlled in accordance with the maximum required suction pressure and/or required change in suction pressure for the identified most loaded cooling entity.

15 Claims, 4 Drawing Sheets

(52) U.S. Cl.
CPC . *F25B 2600/025* (2013.01); *F25B 2600/0272* (2013.01); *F25B 2700/1933* (2013.01); *F25B 2700/2117* (2013.01)

(56) References Cited

U.S. PATENT DOCUMENTS

| | | | |
|---|---|---|---|
| 5,867,995 | A | 2/1999 | Lewis |
| 6,619,062 | B1 * | 9/2003 | Shibamoto ..... F04C 29/0014 62/228.3 |
| 7,207,184 | B2 | 4/2007 | Jessen et al. |
| 7,905,103 | B2 | 3/2011 | Larsen et al. |
| 8,596,081 | B2 | 12/2013 | Bram et al. |
| 8,806,879 | B2 | 8/2014 | Thybo et al. |
| 8,827,546 | B2 | 9/2014 | Vonsild et al. |
| 9,003,827 | B2 | 4/2015 | Thybo et al. |
| 9,157,671 | B2 | 10/2015 | Kawaai et al. |
| 9,217,591 | B2 | 12/2015 | Larsen et al. |
| 9,395,112 | B2 | 7/2016 | Prins |
| 9,416,999 | B2 | 8/2016 | Izadi-Zamanabadi et al. |
| 9,551,335 | B2 | 1/2017 | Prins |
| 9,644,874 | B2 | 5/2017 | Izadi-Zamanabadi et al. |
| 9,696,076 | B2 | 7/2017 | Prins et al. |
| 9,719,700 | B2 | 8/2017 | Prins et al. |
| 10,107,531 | B2 | 10/2018 | Prins |
| 10,181,725 | B2 | 1/2019 | Green |
| 10,378,796 | B2 | 8/2019 | Fredslund et al. |
| 10,508,850 | B2 | 12/2019 | Prins et al. |
| 2005/0210899 | A1 | 9/2005 | Maier et al. |
| 2014/0326002 | A1 | 11/2014 | Sunderland et al. |
| 2015/0165937 | A1 | 6/2015 | Harda et al. |
| 2015/0338137 | A1 | 11/2015 | Funder-Kristensen et al. |
| 2016/0177938 | A1 | 6/2016 | Prins |
| 2017/0219263 | A1 | 8/2017 | Schmidt et al. |
| 2017/0261245 | A1 | 9/2017 | Madsen et al. |
| 2017/0321941 | A1 | 11/2017 | Fredslund et al. |
| 2017/0328604 | A1 | 11/2017 | Fredslund et al. |
| 2018/0164004 | A1 | 6/2018 | Schmidt et al. |
| 2018/0231284 | A1 | 8/2018 | Prins et al. |
| 2018/0283750 | A1 | 10/2018 | Prins et al. |
| 2018/0283754 | A1 | 10/2018 | Prins et al. |
| 2018/0313581 | A1 | 11/2018 | Fredslund et al. |
| 2019/0264962 | A1 | 8/2019 | Schmidt et al. |
| 2019/0299132 | A1 | 10/2019 | Prins et al. |
| 2019/0301773 | A1 | 10/2019 | Fredslund et al. |
| 2019/0301780 | A1 | 10/2019 | Schmidt et al. |
| 2019/0323752 | A1 | 10/2019 | Fredslund et al. |
| 2019/0353413 | A1 | 11/2019 | Larsen et al. |

FOREIGN PATENT DOCUMENTS

| | | | |
|---|---|---|---|
| CN | 104685303 | A | 6/2015 |
| DE | 10011110 | A1 | 10/2001 |
| EP | 0410330 | A2 | 1/1991 |
| EP | 1139037 | A1 | 10/2001 |
| EP | 1261830 | B1 | 11/2004 |
| EP | 1 482 256 | A2 | 12/2004 |
| EP | 2504655 | B1 | 2/2019 |
| KR | 10-0740051 | B1 | 7/2007 |
| RU | 2599218 | C2 | 10/2016 |
| RU | 2612995 | C1 | 3/2017 |
| WO | 2010118745 | A2 | 10/2010 |
| WO | 2011003416 | A2 | 1/2011 |
| WO | 2011072679 | A1 | 6/2011 |
| WO | 2016150663 | A1 | 9/2016 |
| WO | 2017081157 | A1 | 5/2017 |
| WO | 2018117956 | A1 | 10/2018 |

* cited by examiner

METHOD FOR CONTROLLING SUCTION PRESSURE BASED ON A MOST LOADED COOLING ENTITY

CROSS-REFERENCE TO RELATED APPLICATIONS

This application is a National Stage application of International Patent Application No. PCT/EP2018/060572, filed on Apr. 25, 2018, which claims priority to Danish Application No. PA201700276 filed May 1, 2017, each of which is hereby incorporated by reference in its entirety.

TECHNICAL FIELD

The present invention relates to a method for controlling suction pressure in a vapour compression system. According to the method of the invention, the suction pressure is controlled in such a manner that the cooling need of each cooling entity can be met, while keeping the energy consumption of the vapour compression system as low as possible.

BACKGROUND

In a vapour compression system, such as a refrigeration system, an air condition system or a heat pump, a fluid medium, such as a refrigerant, is alternatingly compressed and expanded, while heat exchange takes place in a heat rejecting heat exchanger and one or more evaporators, respectively. Refrigerant leaving the evaporator(s) enters a suction line which interconnects the outlet(s) of the evaporator(s) and the inlet of a compressor unit. The pressure prevailing in the suction line at the inlet of the compressor unit is referred to as the suction pressure.

Since the suction line is connected to the outlet(s) of the evaporator(s), the suction pressure has an impact on the pressure prevailing in the evaporator(s), in the sense that changes in the suction pressure will result in corresponding changes in the pressure prevailing in the evaporator(s).

The heat transfer taking place in an evaporator is dependent on the temperature difference between the evaporating temperature of the refrigerant passing through the evaporator and a target temperature of a refrigerated volume being cooled by means of the evaporator. The evaporating temperature is determined by the properties of the refrigerant and by the pressure prevailing in the evaporator, also referred to as the evaporating pressure. As described above, the pressure prevailing in the evaporator is determined by the suction pressure, and thereby the heat transfer taking place in the evaporator is affected by changes in the suction pressure. A low suction pressure results in a low evaporating pressure and a low evaporating temperature. A low evaporating temperature results in a large temperature difference between the evaporating temperature and the target temperature, and thereby a good heat transfer between the refrigerant and the air in the refrigerated volume. Therefore, in order to ensure good heat transfer, a low suction pressure should be selected.

However, a low suction pressure results in a large pressure difference across the compressor unit. Thereby the work required by the compressor unit in order to increase the pressure of the refrigerant is high, and the energy consumption of the compressor unit is therefore also high. Thus, in order to limit the energy consumption of the vapour compression system, it is desirable to select a high suction pressure.

Thus, it is desirable to select a suction pressure which ensures sufficient heat transfer in each evaporator without excessive energy consumption of the compressor unit.

U.S. Pat. No. 7,207,184 B2 discloses a method for regulating a most loaded circuit of a refrigeration system. Each circuit includes at least one case and an EEPR valve. The operation of each circuit is monitored and a load signal is calculated for each circuit. The load signals are compared and the most loaded circuit is determined. The EEPR valve of the most loaded circuit is adjusted to be approximately 100 percent open and a suction pressure of the compressor is adjusted to move a circuit temperature of the most loaded circuit to a target temperature.

SUMMARY

It is an object of embodiments of the invention to provide a method for controlling suction pressure in a vapour compression system, in which sufficient heat transfer is ensured in each evaporator without excessive energy consumption in the compressor unit.

The invention provides a method for controlling suction pressure in a vapour compression system, the vapour compression system comprising a compressor unit, a heat rejecting heat exchanger and one or more cooling entities arranged in a refrigerant path, each cooling entity comprising an expansion device and an evaporator arranged in thermal contact with a refrigerated volume, the method comprising the steps of:

- for each cooling entity, obtaining a maximum required suction pressure and/or a required change in suction pressure for maintaining a target temperature in the refrigerated volume,
- identifying a most loaded cooling entity among the one or more cooling entities, based on the maximum required suction pressures and/or the required changes in suction pressure, and
- controlling the suction pressure of the vapour compression system in accordance with the maximum required suction pressure and/or required change in suction pressure for the identified most loaded cooling entity.

The method according to the invention is for controlling suction pressure in a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, etc.

The vapour compression system comprises a compressor unit, comprising one or more compressors, a heat rejecting heat exchanger and one or more cooling entities arranged in a refrigerant path. Each cooling entity comprises an expansion device and an evaporator arranged in thermal contact with a refrigerated volume. The refrigerated volume(s) could, e.g., be in the form of display case(s) in a supermarket.

Refrigerant flowing in the refrigerant path is compressed by the compressor(s) of the compressor unit before being supplied to the heat rejecting heat exchanger. In the heat rejecting heat exchanger, heat exchange takes place between the refrigerant and the ambient or a secondary fluid flow across the heat rejecting heat exchanger, in such a manner that heat is rejected from the refrigerant. The heat rejecting heat exchanger may be in the form of a condenser, in which the refrigerant is at least partly condensed. Alternatively, the heat rejecting heat exchanger may be in the form of a gas cooler, in which the refrigerant is cooled, but remains in a gaseous state.

From the heat rejecting heat exchanger the refrigerant is passed to the expansion device(s), where the refrigerant is expanded before entering the evaporator(s). In the evaporator(s), heat exchange takes place between the refrigerant and the air in the refrigerated volumes, in such a manner that heat is absorbed by the refrigerant. The refrigerant passing through the evaporator(s) is at least partly evaporated.

From the evaporator(s) the refrigerant is supplied to the compressor unit, via a suction line. The suction pressure is the pressure prevailing in the suction line, at the inlet of the compressor unit.

Thus, refrigerant circulating in the refrigerant path is alternatingly compressed by the compressor unit and expanded by the expansion device(s), while heat exchange takes place in the heat rejecting heat exchanger and the evaporator(s), respectively.

According to the method of the invention, a maximum required suction pressure and/or a required change in suction pressure for maintaining a target temperature in the refrigerated volume is obtained, for each of the cooling entities. Thus, for each of the cooling entities, a suction pressure level, which is as high possible, but still ensures a heat transfer in the evaporator which is sufficient to maintain the target temperature in the refrigerated volume, is determined. Alternatively, a change in the current suction pressure level may be determined, which has the same effect. In the latter case, the absolute suction pressure level need not be determined, only a relative change in the suction pressure level.

The maximum required suction pressure or required change in suction pressure for a given cooling entity reflects the current load of that cooling entity, in the sense that it reflects a suction pressure level which is required in order for that cooling entity to be able to maintain the target temperature in the refrigerated volume.

The required suction pressure may be substantially equal to a required evaporating pressure for a given cooling entity. However, a pressure drop will normally be introduced in the suction line between the outlet of the evaporator and the inlet of the compressor unit, and therefore the required suction level will normally be lower than the required evaporating pressure. The pressure drop depends on the length of the suction line as well as on other properties of the suction line, and it may depend on the pressure level. The maximum required suction level could, e.g., be derived from a maximum required evaporating pressure, taking the pressure drop into account. This will be described in further detail below.

Next, a most loaded cooling entity among the one or more cooling entities is identified, based on the maximum required suction pressures and/or the required changes in suction pressure. In the present context the term 'most loaded cooling entity' should be interpreted to mean the cooling entity which is currently requiring the lowest suction pressure.

In the case that the vapour compression system comprises only one cooling entity, then this cooling entity is identified as the most loaded cooling entity. In the case that the vapour compression system comprises two or more cooling entities, then one of these is identified as the most loaded cooling entity, based on the previously obtained suction pressure levels and/or changes in suction pressure. This will be described further below.

Finally, the suction pressure of the vapour compression system is controlled in accordance with the maximum required suction pressure and/or required change in suction pressure for the identified most loaded cooling entity.

Accordingly, in the case that maximum required suction pressures were obtained for each of the cooling entities, then the suction pressure is controlled in such a manner that the suction pressure reaches a level which is substantially equal to the maximum required suction pressure of the cooling entity, which was identified as the most loaded cooling entity. Thereby it is ensured that the suction pressure is sufficiently low to ensure a heat transfer in the evaporator of the most loaded cooling entity, which is sufficient for that cooling entity to maintain the target temperature in the refrigerated volume. Furthermore, since this is the most loaded cooling entity, and thereby the cooling entity requiring the lowest suction pressure, the suction pressure will also be sufficiently low to allow the other cooling entities to maintain the target temperature in their respective refrigerated volumes. Finally, the suction pressure is not excessively low, in the sense that it is not allowed to decrease below a level which ensures that the cooling needs of the most loaded cooling entity are just met. Thereby the energy consumption of the compressor unit is maintained at an acceptable level.

Similar remarks apply in the case that changes in suction pressure were obtained for each of the cooling entities, except that in this case the suction pressure is controlled in such a manner that it is adjusted by an amount which is determined by the change in suction pressure for the identified most loaded cooling entity. This will typically be the change which results in the highest decrease of the suction pressure or, in the case that all the obtained changes in suction pressure specify an increase in suction pressure, the change which results in the lowest increase in suction pressure.

The vapour compression system may comprise two or more cooling entities. In this case one of these cooling entities is identified as the most loaded cooling entity. As an alternative, the vapour compression system may comprise one cooling entity, in which case this cooling entity is always identified as the most loaded cooling entity.

In the case that the vapour compression system comprises two or more cooling entities, the step of identifying a most loaded cooling entity may comprise the steps of:

- comparing the maximum required suction pressures obtained for each of the cooling entities, and
- identifying the cooling entity having the lowest maximum required suction pressure as the most loaded cooling entity.

According to this embodiment, maximum required suction pressures were obtained for each of the cooling entities. These maximum required suction pressures are then compared in order to identify the cooling entity having the lowest maximum required suction pressure. This cooling entity is then identified as the most loaded cooling entity, and the suction pressure is controlled in accordance therewith.

As described above, the cooling entity requiring the lowest suction pressure in order to be able to maintain the target temperature in the refrigerated volume is normally also the cooling entity which is most in need of a low suction pressure, and it is therefore appropriate to select this cooling entity as the most loaded cooling entity. Furthermore, when the suction pressure is controlled in such a manner that the maximum required suction pressure of this cooling entity is reached, then the suction pressure will also be sufficiently low to ensure that each of the other cooling entities are capable of maintaining the target temperature in their respective refrigerated volumes, since they all require a higher suction pressure in order to obtain this.

The step of controlling the suction pressure may comprise the steps of:

defining a setpoint value, $P_0$, for the suction pressure, the setpoint value, $P_0$, being the maximum required suction pressure for the most loaded cooling entity, and controlling a compressor capacity of the compressor unit in accordance with the defined setpoint pressure, $P_0$, and in order to obtain a suction pressure which is equal to the setpoint pressure, $P_0$.

According to this embodiment, the suction pressure is controlled by means of a setpoint value, $P_0$. The setpoint value is selected to be exactly the maximum required suction pressure of the cooling entity which was identified as the most loaded cooling entity, i.e. this cooling entity is allowed to 'dictate' the level of the suction pressure. Accordingly, it is efficiently ensured that the suction pressure is sufficiently low to meet the cooling needs of the most loaded cooling entity, but not lower than that.

The step of subsequently controlling the suction pressure could, e.g., be performed using a feedback control loop, in which the suction pressure is measured and fed back to a controller, which then adjusts the suction pressure by adjusting the compressor capacity appropriately, in the case that the measured suction pressure differs from the setpoint value.

As an alternative, the step of controlling the suction pressure may comprise the steps of:

defining a suction pressure adjustment, $\Delta P$, for the suction pressure, the suction pressure adjustment, $\Delta P$, being the required change in suction pressure for the most loaded cooling entity, and controlling a compressor capacity of the compressor unit in accordance with the defined suction pressure adjustment, $\Delta P$, and in order to obtain an adjustment of the current suction pressure which is equal to the defined suction pressure adjustment, $\Delta P$.

According to this embodiment, an absolute setpoint value for the suction pressure is not provided to the controller, based on the identification of the most loaded cooling entity. Instead, the most loaded cooling entity is allowed to 'dictate' how much the current suction pressure is to be adjusted, including whether the suction pressure should be increased or decreased. The step of controlling the compressor capacity could, e.g., include adjusting a setpoint value for the suction pressure in accordance with the suction pressure adjustment, $\Delta P$, and subsequently controlling the compressor capacity in accordance with the adjusted setpoint value, e.g. in the manner described above.

The step of obtaining a maximum required suction pressure and/or a required change in suction pressure for a given cooling entity may be performed by a cooling entity controller arranged to control a supply of refrigerant to that cooling entity. According to this embodiment, 'local' entity controllers associated with the individual cooling entities derive the maximum required suction pressures and/or required changes in suction pressure, and provides this information to a 'central' controller which is arranged to control the suction pressure. The 'central' controller may then apply the information received from each of the entity controllers in order to identify the most loaded cooling entity and control the suction pressure accordingly.

As an alternative, the step of obtaining a maximum required suction pressure and/or a required change in suction pressure for each of the cooling entities may be performed by a central controller, e.g. in the form of a frontend controller or the like.

The method may further comprise the step of deriving performance information relating to the cooling entities and/or relating to the vapour compression system based on the obtained maximum required suction pressures.

According to this embodiment, information regarding the performance of the cooling entities and/or of the vapour compression system as such is derived from the obtained maximum required suction pressures. For instance, in the case that some or all of the cooling entities require a low suction pressure in order to be able to maintain the target temperatures in the respective refrigerated volumes, this is an indication that at least some of the cooling entities are performing poorly. For instance, ice may build up on the evaporator of one of the cooling entities. This will reduce the heat transfer between the refrigerant flowing in the evaporator and the air in the refrigerated volume. Therefore this cooling entity will require a lower evaporating pressure than an ice free evaporator in order to provide the required heat transfer, thereby leading to a lower maximum required evaporating temperature and a lower maximum required suction pressure.

The method may further comprise the step of identifying one or more cooling entities with degraded performance, based on the derived performance information. For instance, if one of the cooling entities requires a suction pressure which is significantly lower than the suction pressure required by the other cooling entities, it may be concluded that this cooling entity has a low performance, and measures may be taken in order to improve this. Alternatively or additionally, the performance information may be used for determining whether or not the performance of the vapour compression system is homogeneous, i.e. whether the performance of the cooling entities is substantially homogeneous throughout the vapour compression system, or there are large variations in the performance of the individual cooling entities.

The method may further comprise the step of, for each cooling entity, obtaining a maximum required evaporating pressure for maintaining a target temperature in the refrigerated volume, and the step of obtaining a maximum required suction pressure and/or change in suction pressure for a given cooling entity may be based on the maximum required evaporating pressure for that cooling entity.

According to this embodiment, when performing the step of obtaining a maximum required suction pressure and/or a required change in suction pressure for a given cooling entity, a maximum required evaporating pressure for maintaining a target temperature in the refrigerated volume is initially obtained. As described above, in order to provide a sufficient heat transfer between the refrigerant flowing in the evaporator and the air in the refrigerated volume to allow the target temperature to be maintained, there must be a certain minimum temperature difference between the target temperature and the evaporating temperature of the refrigerant. The evaporating temperature is dependent on the evaporating pressure, and therefore a certain evaporating pressure, corresponding to the evaporating temperature providing the required minimum temperature difference, must prevail in the evaporator. This evaporating pressure can be obtained by providing a suitably corresponding suction pressure, since the outlet of the evaporator is directly connected to the suction line, and the pressure prevailing in the evaporator is therefore dependent on the suction pressure. The suction pressure required in order to provide a given evaporating pressure may be substantially equal to the evaporating pressure. However, a pressure drop will normally be introduced in the suction line, and therefore the required suction pressure is normally somewhat lower than the required evaporating pressure.

The required suction pressure may be derived or calculated from the required evaporating pressure in various ways. For instance, a model based approach may be applied, in which knowledge about the design of the suction line and properties of the refrigerant may be used for generating a model for the correlation between the suction pressure and the evaporating pressure, and this model may subsequently be used for deriving the required suction pressure. Alternatively or additionally, a constant pressure drop in the suction line may be assumed, in which case the required suction pressure is simply assumed to be a pressure level which is lower than the required evaporating pressure by a pressure difference which is equal to the constant pressure drop. As another alternative, an empirical approach may be applied, in which corresponding values of evaporating pressure and suction pressure are measured and possibly stored in a look-up table, which is subsequently used for deriving the required suction pressure from the required evaporating pressure.

The step of identifying a most loaded cooling entity may further be based on the maximum required evaporating pressures. For instance, the maximum required evaporating pressures may be compared, and the cooling entity having the lowest maximum required evaporating pressure may be identified as the most loaded cooling entity.

BRIEF DESCRIPTION OF THE DRAWINGS

The invention will now be described in further detail with reference to the accompanying drawings in which.

DETAILED DESCRIPTION

Figure 1:
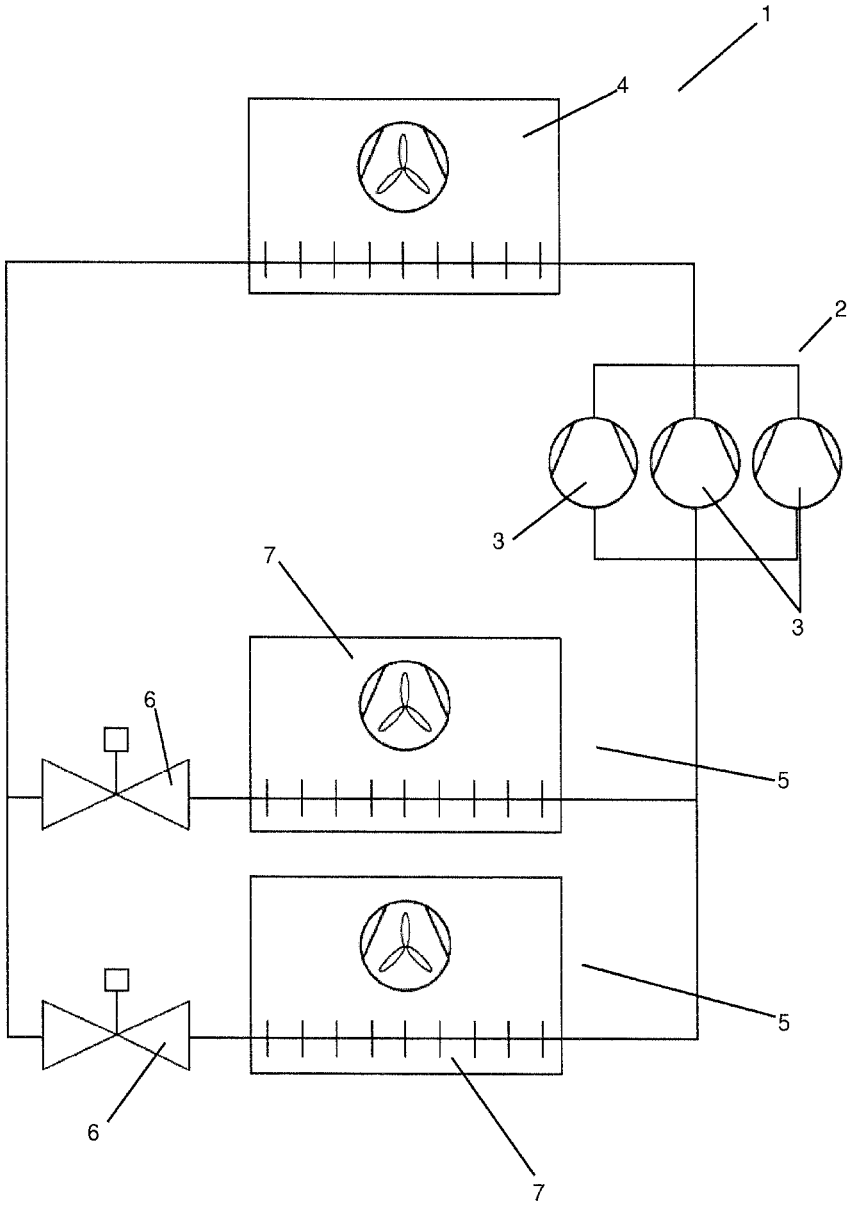
FIG. 1 is a diagrammatic view of a vapour compression system being controlled by means of a method according to an embodiment of the invention.

FIG. 1 is a diagrammatic view of a vapour compression system 1 being controlled by means of a method according to an embodiment of the invention. The vapour compression system 1 comprises a compressor unit 2 comprising a number of compressors 3, three of which are shown, a heat rejecting heat exchanger 4 and two cooling entities 5 arranged in a refrigerant path. It should be noted that it is not ruled out that the vapour compression system 1 comprises further cooling entities 5.

Each cooling entity 5 comprises an expansion device 6, in the form of an expansion valve, and an evaporator 7. The evaporators 7 are each arranged in thermal contact with a refrigerated volume, e.g. in the form of a display case. The expansion devices 6 each control the supply of refrigerant to the corresponding evaporator 7.

The pressure of refrigerant entering the compressor unit 2 is referred to as the suction pressure. This pressure level is controlled in accordance with a method according to an embodiment of the invention.

Initially, for each of the cooling entities 5, a maximum required suction pressure and/or a required change in suction pressure for maintaining a target temperature in the corresponding refrigerated volume is obtained. The target temperature is typically an air temperature inside the refrigerated volume which is required in order to maintain the quality of products stored in the refrigerated volume.

Obtaining the maximum required suction pressure and/or a required change in suction pressure for a given cooling entity 5 could, e.g., include determining the highest possible evaporating temperature which would ensure a sufficient heat transfer between the refrigerant flowing through the evaporator 7 and the air inside the refrigerated volume to maintain the target temperature inside the refrigerated volume. As an alternative to determining an absolute value of the evaporating temperature, a required change in evaporating temperature could be determined.

From the determined evaporating temperature, or change in evaporating temperature, a corresponding evaporating pressure, or change in evaporating pressure, can be derived, based on characteristics of the refrigerant. Based on this derived evaporating pressure, or change in evaporating pressure, a corresponding suction pressure, or change in suction pressure, can be derived, with due consideration to any pressure drop which might take place between the evaporator 7 and the inlet of the compressor unit 2.

Next, the most loaded cooling entity 5 is identified, based on the maximum required suction pressures and/or the required changes in suction pressure. This could, e.g., include comparing the obtained maximum required suction pressures and/or required changes in suction pressure and selecting the cooling entity 5 which requires the lowest suction pressure in order to be able to maintain the required target temperature in its refrigerated volume. In general, the lower the suction pressure, the lower the pressure levels in the evaporators 7 will be. A low pressure level in an evaporator 7 provides a low evaporating temperature, and thereby a large temperature difference between the evaporating temperature and the target temperature inside the refrigerated volume. This, in turn, provides a good heat transfer between the refrigerant flowing through the evaporator 7 and the air inside the refrigerated volume. Accordingly, the lower the suction pressure, the easier it will be for the cooling entities 5 to maintain the target temperatures inside the refrigerated volumes. It can therefore be assumed that if the suction pressure is controlled to be at a level which corresponds to the highest possible suction pressure which enables the most loaded cooling entity 5 to maintain the target temperature in its refrigerated volume, then the suction pressure will also be sufficiently low to enable all of the other cooling entities 5 to maintain the target temperature in their respective refrigerated volumes.

Accordingly, the suction pressure is subsequently controlled in accordance with the maximum required suction pressure and/or required change in suction pressure for the identified most loaded cooling entity 5. Thereby it is ensured that the suction pressure is sufficiently low to enable all of the cooling entities 5 to maintain the target temperatures in the refrigerated volumes, but it is not excessively low. This is an advantage because a low suction pressure requires a large pressure increase to be provided by the compressors 3 of the compressor unit 2, and this is energy consuming. Therefore, keeping the suction pressure at a level which only just meets the requirements of each of the cooling entities 5 minimises the energy consumption.

Figure 2:
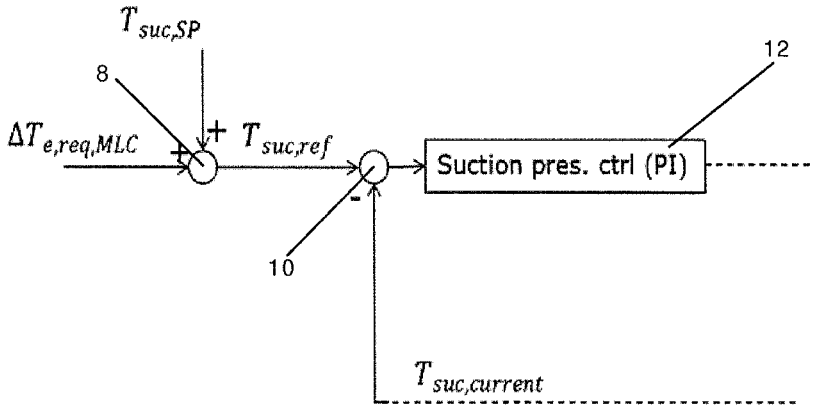
FIG. 2 is a control diagram illustrating a method according to an embodiment of the invention.

FIG. 2 is a control diagram illustrating a method according to an embodiment of the invention. A requested change in suction temperature, $\Delta T_{e,req,i}$, is obtained for each cooling entity of the vapour compression system. The most loaded cooling entity is then identified as the cooling entity requesting the largest change in suction temperature, i.e.

$$\Delta T_{e,req,MLC}=\max_{i\in N}(\Delta T_{e,req,i}),$$

where 'MLC' denotes the most loaded cabinet, i.e. the most loaded cooling entity. 'i' is the numbering of the cooling entities, and N is the number of cooling entities in the suction group. The requested change in suction temperature of the most loaded cooling entity is supplied to an adder 8 which also receives a user defined suction temperature setpoint value, $T_{suc,SP}$.

In adder 8 the requested change in suction temperature of the most loaded cooling entity, $\Delta T_{e,req,MLC}$, and the user defined suction temperature setpoint value, $T_{suc,SP}$, are added. The output from adder 8 is a suction temperature reference, $T_{suc,ref}$, which is supplied to a second adder 10.

In the second adder 10 the current suction temperature, $T_{suc,current}$, is subtracted from the suction temperature reference, $T_{suc,ref}$. The output of the second adder 10 is supplied to a suction pressure controller 12 which controls the suction pressure of the vapour compression system in accordance therewith, e.g. applying a proportional integral (PI) control strategy.

Figure 3:
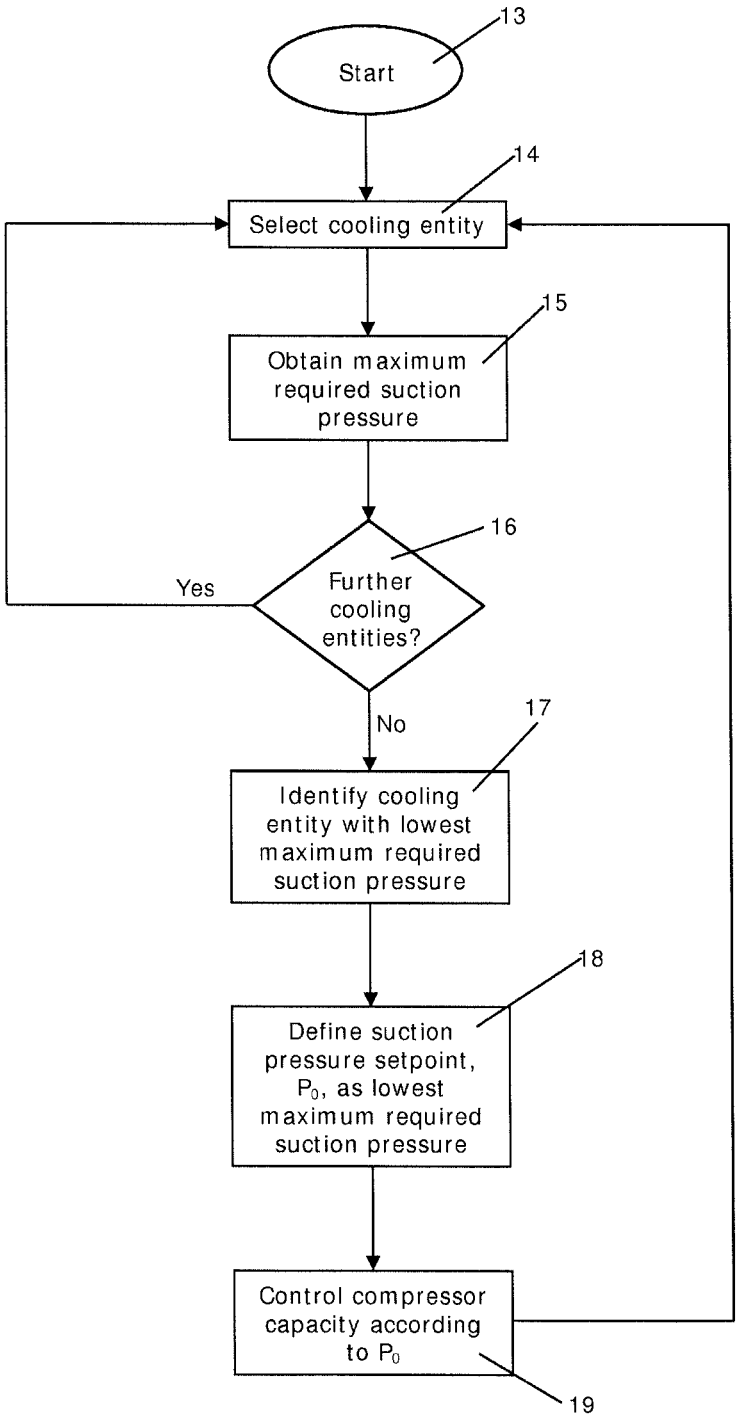
FIG. 3 is a flow chart illustrating a method according to a first embodiment of the invention.

FIG. 3 is a flow chart illustrating a method for controlling suction pressure of a vapour compression system according to a first embodiment of the invention. The vapour compression system could, e.g., be of the kind illustrated in FIG. 1.

The process is started at step 13. At step 14 one of the cooling entities of the vapour compression system is selected. At step 15 a maximum required suction pressure for maintaining a target temperature in the refrigerated volume of the selected cooling entity is obtained. Thus, the maximum required suction pressure is the highest suction pressure which results in a heat transfer between refrigerant flowing through the evaporator and the air inside the refrigerated volume being sufficient to maintain the target temperature inside the refrigerated volume.

At step 16 it is investigated whether or not further cooling entities exist, i.e. whether or not a maximum required suction pressure has been obtained for all of the cooling entities of the vapour compression system. If further cooling entities exist, the process is returned to step 14, and a new cooling entity is selected.

In the case that step 16 reveals that there are no further cooling entities, i.e. that a maximum required suction pressure has been obtained for all of the cooling entities of the vapour compression system, the process is forwarded to step 17. At step 17 the cooling entity with the lowest maximum required suction pressure is identified. This could, e.g., include comparing the maximum required suction pressures obtained for each of the cooling entities. The identified cooling entity is regarded as the most loaded cooling entity.

At step 18 a suction pressure setpoint, $P_0$, is defined as the maximum required suction pressure of the most loaded cooling entity, which was identified in step 17. Since the most loaded cooling entity is the one which requires the lowest suction pressure in order to be able to maintain the target temperature inside its refrigerated volume, controlling the suction pressure to this level will ensure that the suction pressure is sufficiently low to ensure that all of the cooling entities are able to maintain the target temperature inside their respective refrigerated volumes.

Finally, at step 19 the compressor capacity of the vapour compression system is controlled according to this suction pressure setpoint, $P_0$. Thereby it is ensured that all of the cooling entities are able to maintain the target temperature inside their respective refrigerated volumes, while ensuring that the suction pressure is not excessively low.

Figure 4:
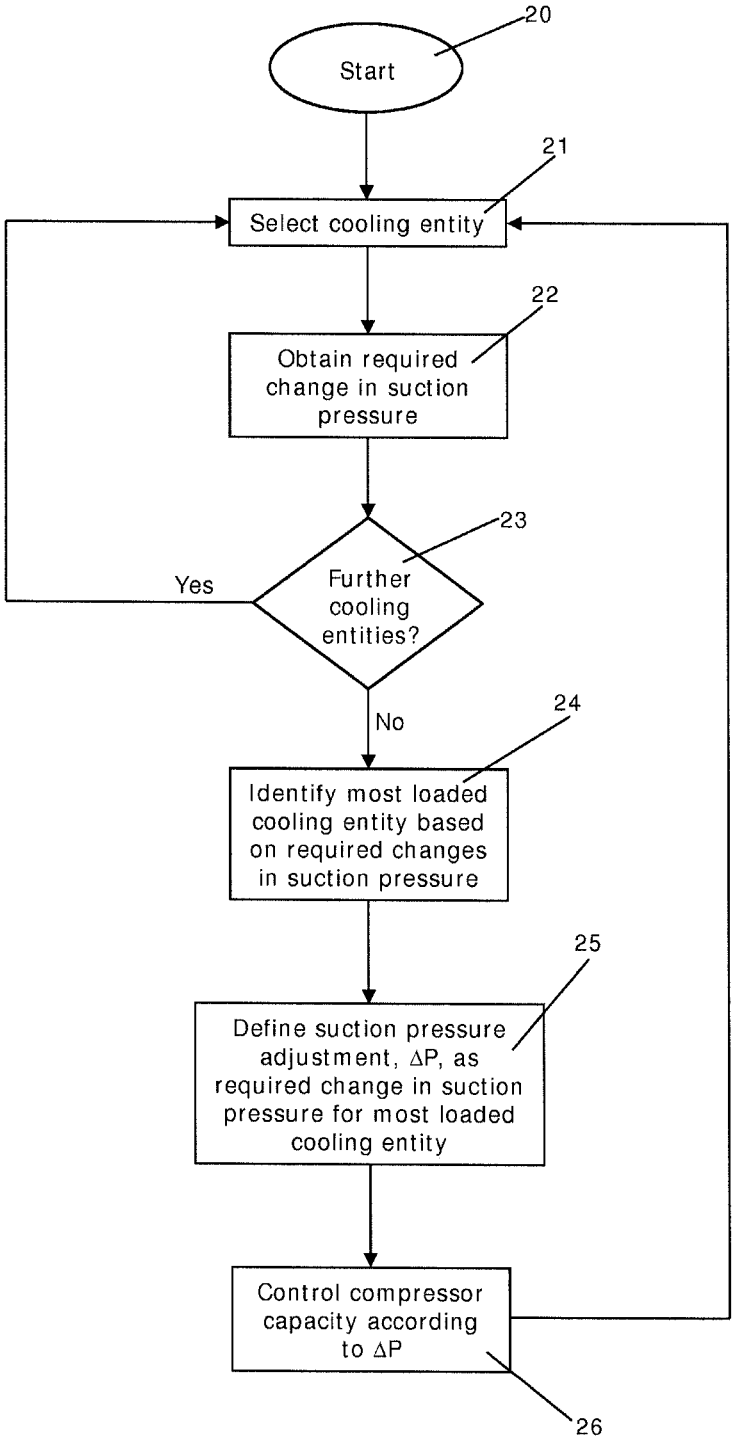
FIG. 4 is a flow chart illustrating a method according to a second embodiment of the invention.

FIG. 4 is a flow chart illustrating a method for controlling suction pressure of a vapour compression system according to a second embodiment of the invention. The vapour compression system could, e.g., be of the kind illustrated in FIG. 1.

The process is started at step 20. At step 21 one of the cooling entities of the vapour compression system is selected. At step 22 a required change in suction pressure for maintaining a target temperature in the refrigerated volume of the selected cooling entity is obtained. Thus, the required change in suction pressure is the minimum change with respect to the current suction pressure, which is required in order to ensure a heat transfer between refrigerant flowing through the evaporator and the air inside the refrigerated volume being sufficient to maintain the target temperature inside the refrigerated volume.

At step 23 it is investigated whether or not further cooling entities exist, i.e. whether or not a required change in suction pressure has been obtained for all of the cooling entities of the vapour compression system. If further cooling entities exist, the process is returned to step 21, and a new cooling entity is selected.

In the case that step 23 reveals that there are no further cooling entities, i.e. that a required change in suction pressure has been obtained for all of the cooling entities of the vapour compression system, the process is forwarded to step 24. At step 24 the most loaded cooling entity is identified, based on the required changes in suction pressure. More specifically, the most loaded cooling entity is the one where the required change in suction pressure results in the lowest suction pressure.

At step 25 a suction pressure adjustment, ΔP, is defined as the required change in suction pressure for the most loaded cooling entity, which was identified in step 24. Since the most loaded cooling entity is the one which requires the lowest suction pressure in order to be able to maintain the target temperature inside its refrigerated volume, adjusting the suction pressure by this required change in suction pressure will ensure that the suction pressure is sufficiently low to ensure that all of the cooling entities are able to maintain the target temperature inside their respective refrigerated volumes.

Finally, at step 26 the compressor capacity of the vapour compression system is controlled according to this suction pressure adjustment, ΔP. This could, e.g., include adjusting a suction pressure setpoint value by the suction pressure adjustment, ΔP, and subsequently control the compressor capacity in accordance with the adjusted setpoint value. Thereby it is ensured that all of the cooling entities are able to maintain the target temperature inside their respective refrigerated volumes, while ensuring that the suction pressure is not excessively low.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling suction pressure in a vapour compression system, the vapour compression system comprising a compressor unit, a heat rejecting heat exchanger and two or more cooling entities arranged in a refrigerant path, each cooling entity comprising an expansion device and an evaporator arranged in thermal contact with a respective refrigerated volume, the method comprising the steps of:

for each cooling entity, obtaining a maximum required suction pressure and/or a required change in suction pressure for maintaining a target temperature in the respective refrigerated volume, identifying a most loaded cooling entity among the two or more cooling entities, based on the maximum required suction pressures and/or the required changes in suction pressure, and controlling the suction pressure of the vapour compression system in accordance with the maximum required suction pressure and/or required change in suction pressure for the identified most loaded cooling entity.

2. The method according to claim 1, wherein the step of identifying a most loaded cooling entity comprises the steps of:

comparing the maximum required suction pressures obtained for each of the cooling entities, and identifying the cooling entity having the lowest maximum required suction pressure as the most loaded cooling entity.

3. The method according to claim 1, wherein the step of controlling the suction pressure comprises the steps of:

defining a setpoint value, $P_0$, for the suction pressure, the setpoint value, $P_0$, being the maximum required suction pressure for the most loaded cooling entity, and controlling a compressor capacity of the compressor unit in accordance with the defined setpoint pressure, $P_0$, and in order to obtain a suction pressure which is equal to the setpoint pressure, $P_0$.

4. The method according to claim 1, wherein the step of controlling the suction pressure comprises the steps of:

defining a suction pressure adjustment, ΔP, for the suction pressure, the suction pressure adjustment, ΔP, being the required change in suction pressure for the most loaded cooling entity, and controlling a compressor capacity of the compressor unit in accordance with the defined suction pressure adjustment, ΔP, and in order to obtain an adjustment of the current suction pressure which is equal to the defined suction pressure adjustment, ΔP.

5. The method according to claim 1, wherein the step of obtaining a maximum required suction pressure and/or a required change in suction pressure for a given cooling entity is performed by a cooling entity controller arranged to control a supply of refrigerant to that cooling entity.

6. The method according to claim 1, further comprising the step of deriving performance information relating to the cooling entities and/or relating to the vapour compression system based on the obtained maximum required suction pressures.

7. The method according to claim 6, further comprising the step of identifying one or more cooling entities with degraded performance, based on the derived performance information.

8. The method according to claim 1, further comprising the step of, for each cooling entity, obtaining a maximum required evaporating pressure for maintaining a target temperature in the respective refrigerated volume, and wherein the step of obtaining a maximum required suction pressure and/or change in suction pressure for a given cooling entity is based on the maximum required evaporating pressure for that cooling entity.

9. The method according to claim 8, wherein the step of identifying a most loaded cooling entity is further based on the maximum required evaporating pressures.

10. The method according to claim 2, wherein the step of controlling the suction pressure comprises the steps of:

defining a setpoint value, $P_0$, for the suction pressure, the setpoint value, $P_0$, being the maximum required suction pressure for the most loaded cooling entity, and controlling a compressor capacity of the compressor unit in accordance with the defined setpoint pressure, $P_0$, and in order to obtain a suction pressure which is equal to the setpoint pressure, $P_0$.

11. The method according to claim 2, wherein the step of controlling the suction pressure comprises the steps of:

defining a suction pressure adjustment, ΔP, for the suction pressure, the suction pressure adjustment, ΔP, being the required change in suction pressure for the most loaded cooling entity, and controlling a compressor capacity of the compressor unit in accordance with the defined suction pressure adjustment, ΔP, and in order to obtain an adjustment of the current suction pressure which is equal to the defined suction pressure adjustment, ΔP.

12. The method according to claim 2, wherein the step of obtaining a maximum required suction pressure and/or a required change in suction pressure for a given cooling entity is performed by a cooling entity controller arranged to control a supply of refrigerant to that cooling entity.

13. The method according to claim 3, wherein the step of obtaining a maximum required suction pressure and/or a required change in suction pressure for a given cooling entity is performed by a cooling entity controller arranged to control a supply of refrigerant to that cooling entity.

14. The method according to claim 4, wherein the step of obtaining a maximum required suction pressure and/or a required change in suction pressure for a given cooling entity is performed by a cooling entity controller arranged to control a supply of refrigerant to that cooling entity.

15. The method according to claim 2, further comprising the step of deriving performance information relating to the cooling entities and/or relating to the vapour compression system based on the obtained maximum required suction pressures.

* * * * *